US011597991B2

(12) United States Patent
Strock

(10) Patent No.: US 11,597,991 B2
(45) Date of Patent: Mar. 7, 2023

(54) ALUMINA SEAL COATING WITH INTERLAYER

(71) Applicant: United Technologies Corporation, Farmington, CT (US)

(72) Inventor: Christopher W. Strock, Kennebunk, ME (US)

(73) Assignee: Raytheon Technologies Corporation, Farmington, CT (US)

( * ) Notice: Subject to any disclaimer, the term of this patent is extended or adjusted under 35 U.S.C. 154(b) by 905 days.

(21) Appl. No.: 15/633,114

(22) Filed: Jun. 26, 2017

(65) Prior Publication Data

US 2018/0371599 A1 Dec. 27, 2018

(51) Int. Cl.

| | |
|---|---|
| ***C23C 4/06*** | (2016.01) |
| ***F01D 11/00*** | (2006.01) |
| ***C23C 4/12*** | (2016.01) |
| ***F01D 11/12*** | (2006.01) |
| ***C23C 28/00*** | (2006.01) |
| ***C23C 4/073*** | (2016.01) |
| ***C23C 4/11*** | (2016.01) |

(52) U.S. Cl.

CPC ..... *C23C 4/06* (2013.01); *C23C 4/073* (2016.01); *C23C 4/11* (2016.01); *C23C 4/12* (2013.01); *C23C 28/3215* (2013.01); *C23C 28/3455* (2013.01); *C23C 28/36* (2013.01); *F01D 11/001* (2013.01); *F01D 11/122* (2013.01); *F05D 2220/32* (2013.01); *F05D 2230/31* (2013.01); *F05D 2300/172* (2013.01); *F05D 2300/177* (2013.01); *F05D 2300/21* (2013.01); *F05D 2300/6111* (2013.01)

(58) Field of Classification Search

None

See application file for complete search history.

(56) References Cited

U.S. PATENT DOCUMENTS

| | | | | |
|---|---|---|---|---|
| 5,683,825 | A | 11/1997 | Bruce et al. | |
| 7,008,674 | B2 | 3/2006 | Nagaraj et al. | |
| 9,316,110 | B2 * | 4/2016 | Cottom | F01D 11/122 |

(Continued)

FOREIGN PATENT DOCUMENTS

| | | | |
|---|---|---|---|
| EP | 2905426 | A1 | 8/2015 |
| EP | 3178799 | A1 | 6/2017 |

(Continued)

OTHER PUBLICATIONS

European Search Report dated Oct. 19, 2018 issued in corresponding European Patent Application No. 18179881.0.

*Primary Examiner* — Xiaobei Wang

(74) *Attorney, Agent, or Firm* — Bachman & LaPointe, P.C.

(57) ABSTRACT

An abrasive coating for a substrate including a metallic based bond coat layer; a top layer; and an intermediate layer between the metallic based bond coat layer and the top layer. A method of applying an abrasive coating including applying a metallic based bond coat layer onto a substrate; grading an intermediate layer into the metallic based bond coat layer to form a graded transition between the metallic based bond coat layer and the intermediate layer; and grading a top layer into the intermediate layer to form a graded transition between the intermediate layer and the top layer.

20 Claims, 7 Drawing Sheets

(56) References Cited

U.S. PATENT DOCUMENTS

| | | | | |
|---|---|---|---|---|
| 2009/0053554 | A1* | 2/2009 | Strock | C22C 19/055 428/651 |
| 2010/0311562 | A1* | 12/2010 | Xie | C04B 35/486 427/226 |
| 2011/0086163 | A1* | 4/2011 | Ma | C23C 4/02 427/8 |
| 2012/0034471 | A1* | 2/2012 | Peterson | C23C 4/02 428/457 |
| 2012/0189434 | A1* | 7/2012 | Strock | F01D 5/284 415/173.4 |
| 2013/0108421 | A1* | 5/2013 | Sinatra | F01D 11/122 415/182.1 |
| 2013/0115479 | A1* | 5/2013 | Stamm | F01D 5/288 428/613 |
| 2015/0044035 | A1* | 2/2015 | Cottom | C23C 28/3455 415/173.4 |
| 2016/0177971 | A1* | 6/2016 | Bagnall | B24B 19/14 451/28 |
| 2016/0311726 | A1 | 10/2016 | Kirby | |
| 2016/0348250 | A1 | 12/2016 | Ahmad | |
| 2017/0167279 | A1 | 6/2017 | Kirby et al. | |
| 2018/0222807 | A1* | 8/2018 | Shim | C04B 41/52 |

FOREIGN PATENT DOCUMENTS

| | | | |
|---|---|---|---|
| WO | 2011100311 | A1 | 8/2011 |
| WO | 2015130362 | A2 | 9/2015 |

* cited by examiner

| | Not Graded | | | | Graded | | | |
|---|---|---|---|---|---|---|---|---|
| | Approx. fraction of total thickness | Thin without transitions (Mils) | Medium without transitions (Mils) | Thick without transitions (Mils) | Approx. fraction of total thickness | Thin with transitions (Mils) | Medium with transitions (Mils) | Thick with transitions (MIls) |
| Total | 1 | 10 | 20 | 40 | 1 | 10 | 20 | 40 |
| Bond (84) | 0.3 | 3 | 6 | 12 | 0.25 | 2.5 | 5 | 10 |
| Transition (90) | 0 | 0 | 0 | 0 | 0.1 | 1 | 2 | 4 |
| Zirconia (86) | 0.15 | 1.5 | 3 | 6 | 0.1 | 1 | 2 | 4 |
| Transition (92) | 0 | 0 | 0 | 0 | 0.1 | 1 | 2 | 4 |
| Alumina (88) | 0.55 | 5.5 | 11 | 22 | 0.45 | 4.5 | 9 | 18 |

*FIG. 6*

| | Minimum fractions of total thickness | Nominal fractions of total thickness | Maximum fractions of total thickness |
|---|---|---|---|
| Bond (84) | 0.1 | 0.25 | 0.5 |
| Transition (90) | 0 | 0.1 | 0.3 |
| Zirconia (86) | 0.05 | 0.1 | 0.3 |
| Transition (92) | 0 | 0.1 | 0.3 |
| Alumina (88) | 0.2 | 0.45 | 0.6 |

*FIG. 7*

ALUMINA SEAL COATING WITH INTERLAYER

BACKGROUND

The present disclosure relates to a seal coating and, more particularly, to an alumina abrasive seal coating with an interlayer and a graded transition.

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor and turbine sections typically include stages that include rotating airfoils interspersed between fixed vanes of a stator assembly.

In gas turbine engines, it is generally desirable for efficient operation to maintain minimum rotor tip clearances, with a substantially constant clearance. This is typical for cantilevered stators in an axial compressor. This may be difficult to achieve due to various asymmetric effects either from build or during operation.

Typically, an abrasive coating is used to coat a rotor adjacent to cantilevered stators to wear away the vane tips to accommodate the various asymmetric effects and thereby provide a close, constant clearance. Although effective, the abrasive coatings may show increased levels of premature spallation over prolonged operations.

SUMMARY

An abrasive coating for a substrate according to one disclosed non-limiting embodiment of the present disclosure includes an intermediate layer between a metallic based bond coat layer and a top layer.

A further aspect of the present disclosure includes that the substrate is a nickel based metallic based alloy.

A further aspect of the present disclosure includes that the metallic based bond coat is one of a nickel based, copper based, and cobalt based alloy.

A further aspect of the present disclosure includes that a graded transition between the metallic based bond coat layer and the top layer forms the intermediate layer.

A further aspect of the present disclosure includes a graded transition between the intermediate layer and the top layer.

A further aspect of the present disclosure includes that the metallic based bond coat layer is 3-12 mils (76-305 microns) thick and has a porosity of less than 20 volume percent.

A further aspect of the present disclosure includes that the top layer is 5.5-22 mils (140-559 microns) thick and has a porosity of 1-20 volume percent.

A further aspect of the present disclosure includes that the intermediate layer is a zirconia based layer.

A further aspect of the present disclosure includes that the intermediate layer is a partially stabilized zirconia.

A further aspect of the present disclosure includes that the intermediate layer is 1-3 mils (25-76 microns) thick.

A further aspect of the present disclosure includes that the intermediate layer includes 7 weight percent yttria stabilized zirconia.

An abrasive coating for application to a substrate according to one disclosed non-limiting embodiment of the present disclosure includes a metallic based bond coat layer; an intermediate layer graded into the metallic based bond coat layer to form a graded transition between the metallic based bond coat layer and the intermediate layer; and a top layer graded into the intermediate layer to form a graded transition between the intermediate layer and the top layer.

A further aspect of the present disclosure includes that the substrate is a metallic based alloy.

A further aspect of the present disclosure includes that the graded transition is 1 to 4 mils (25-102 microns) thick.

A further aspect of the present disclosure includes that the graded transitions forms a 0-0.3 fraction of the total thickness of the abrasive coating.

A method of applying an abrasive coating according to one disclosed non-limiting embodiment of the present disclosure includes applying a metallic based bond coat layer onto a substrate; grading an intermediate layer into the metallic based bond coat layer to form a graded transition between the metallic based bond coat layer and the intermediate layer; and grading a top layer into the intermediate layer to form a graded transition between the intermediate layer and the top layer.

A further aspect of the present disclosure includes that grading the intermediate layer into the metallic based bond coat layer includes spraying a material to form the intermediate layer from a first spray system while spraying a material to form the metallic based bond coat layer from a second spray system.

A further aspect of the present disclosure includes that the second system reduces deposition of materials for the metallic based bond coat layer while the first system increases deposition of materials for the intermediate layer until a full 100 percent of materials for the intermediate layer is being sprayed by the first system and 0 percent of materials for the metallic based bond coat layer are being sprayed to form the graded transition between the metallic based bond coat layer and the intermediate layer, then the intermediate layer.

A further aspect of the present disclosure includes spraying the top layer materials from a first spray system while spraying the intermediate layer materials from a second spray system.

A further aspect of the present disclosure includes that the second spray system reduces deposition of materials for the intermediate layer while the first spray system increases deposition of top layer materials until a full 100 percent of materials for the top layer is being sprayed by the first system and 0 percent of materials for the intermediate layer are being sprayed to form the graded transition between the intermediate layer and the top layer, then the top layer.

The foregoing features and elements may be combined in various combinations without exclusivity, unless expressly indicated otherwise. These features and elements as well as the operation of the invention will become more apparent in light of the following description and the accompanying drawings. It should be appreciated, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows:

FIG. 6 is a chart of nominal layer thicknesses and ratios for various total coating thicknesses with and without graded transitions according to one disclosed non-limiting embodiment.

FIG. 7 is a chart of an example range of ratios for various layer thickness combinations.

DETAILED DESCRIPTION

Figure 1:
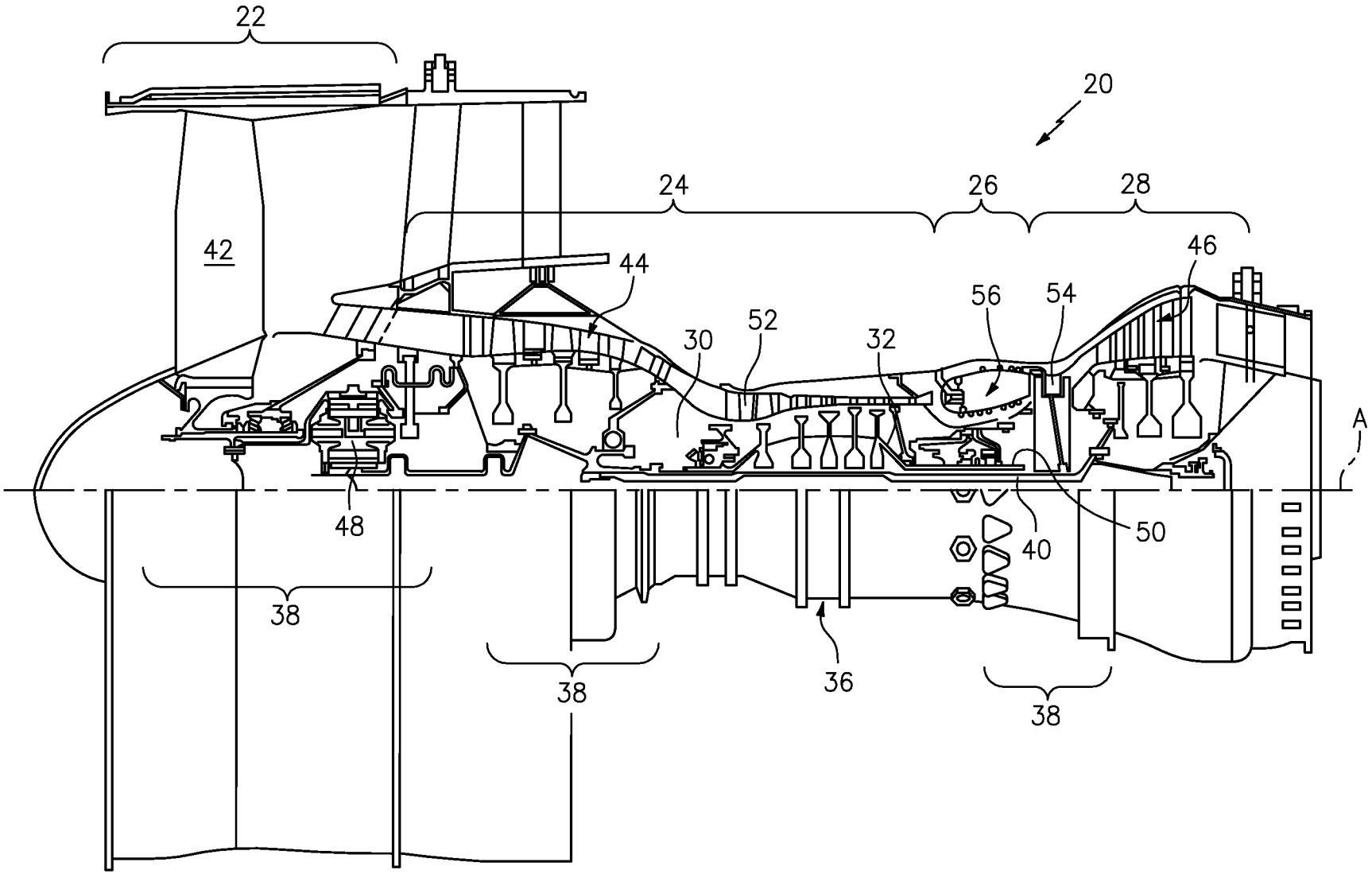
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flowpath while the compressor section 24 drives air along a core flowpath for compression and communication into the combustor section 26 then expansion through the turbine section 28. Although depicted as a turbofan in the disclosed non-limiting embodiment, it should be appreciated that the concepts described herein are not limited only thereto.

The engine 20 generally includes a low spool 30 and a high spool 32 mounted for rotation around an engine central longitudinal axis A relative to an engine static structure 36 via several bearing compartments 38. The low spool 30 generally includes an inner shaft 40 that interconnects a fan 42, a low pressure compressor 44 ("LPC") and a low pressure turbine 46 ("LPT"). The inner shaft 40 drives the fan 42 directly or through a geared architecture 48 to drive the fan 42 at a lower speed than the low spool 30. An exemplary reduction transmission is an epicyclic transmission, namely a planetary or star gear system. The high spool 32 includes an outer shaft 50 that interconnects a high pressure compressor 52 ("HPC") and high pressure turbine 54 ("HPT"). A combustor 56 is arranged between the HPC 52 and the HPT 54. The inner shaft 40 and the outer shaft 50 are concentric and rotate around the engine central longitudinal axis A which is collinear with their longitudinal axes. The main engine shafts 40, 50 are supported at a plurality of points by the bearing compartments 38. Core airflow is compressed by the LPC 44 then the HPC 52, mixed with fuel and burned in the combustor 56, then expanded over the HPT 54 and the LPT 46. The turbines 54, 46 rotationally drive the respective low spool 30 and high spool 32 in response to the expansion.

Figure 2:
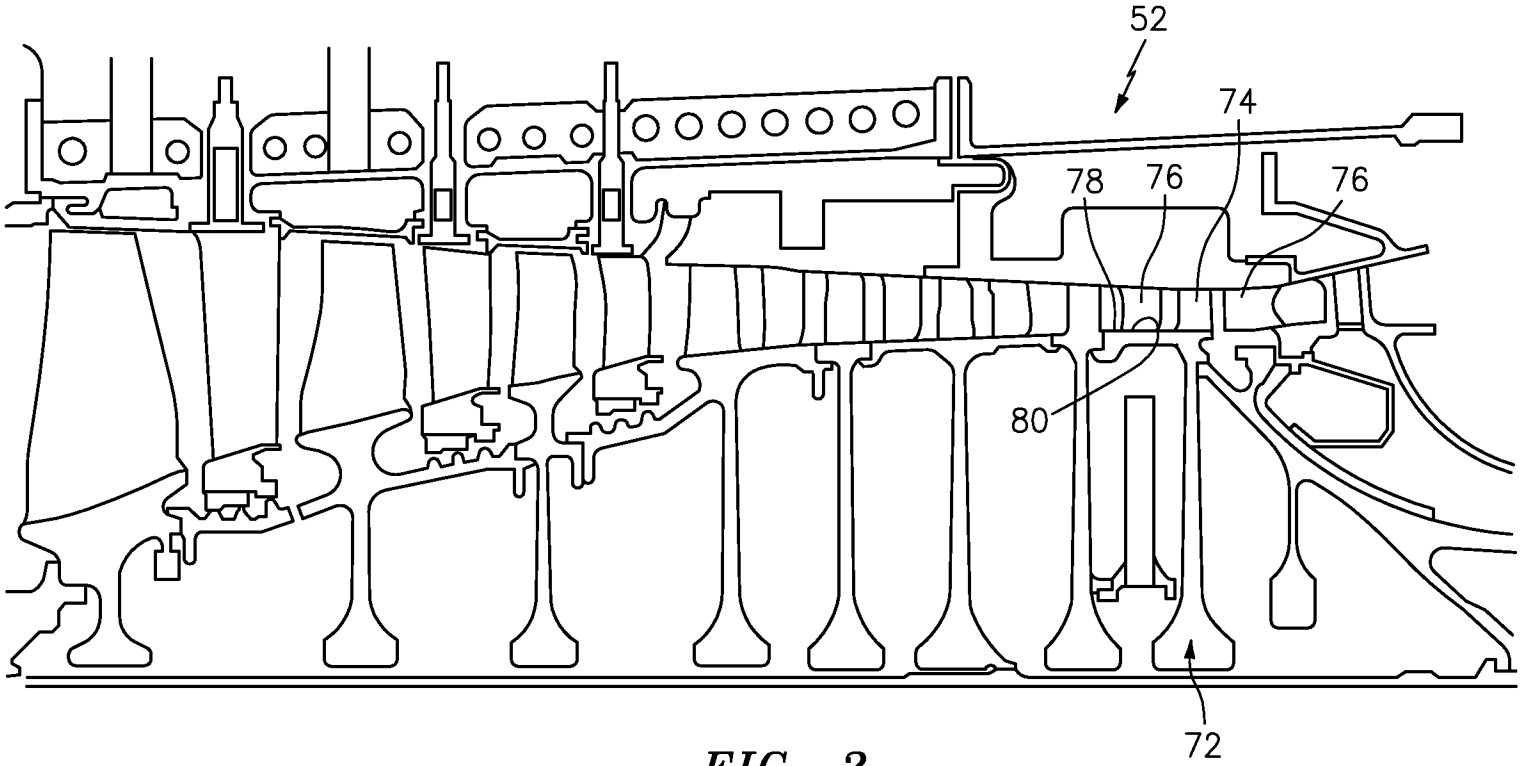
FIG. 2 is a longitudinal schematic sectional view of a compressor section of the gas turbine engine shown in FIG. 1.

With reference to FIG. 2, an exemplary HPC 52 includes a multiple of cantilevered stators 70 (FIG. 3) adjacent to a respective rotor disk 72. The rotor disk 72 includes an abrasive section 80 on a hub surface 78 from which extends a multiple of rotor blades 74 adjacent to the cantilevered stator 70. The abrasive section 80 operates as an interface for a multiple of vanes 76 (FIG. 2) of the cantilevered stator 70. During initial running of the engine 20, most, if not all, of the associated vanes 76 rub against the abrasive section 80 to provide a close and constant clearance that forms an effective seal. That is, the abrasive section 80 is the abrasive and the vanes 76 are the abradeable. In one example, it may be desirable that about 80 percent of the linear and/or radial wear be on the stationary component and 20 percent of the linear and or radial wear be on the rotating component. Due to the space between vanes (solidity) the volumetric wear values may be different. The abrasive section 80 is a thermal spray coating that has a roughness that, when rubbing against the vane tip, wears a little of the vane tip away, to facilitate a desired clearance.

Figure 3:
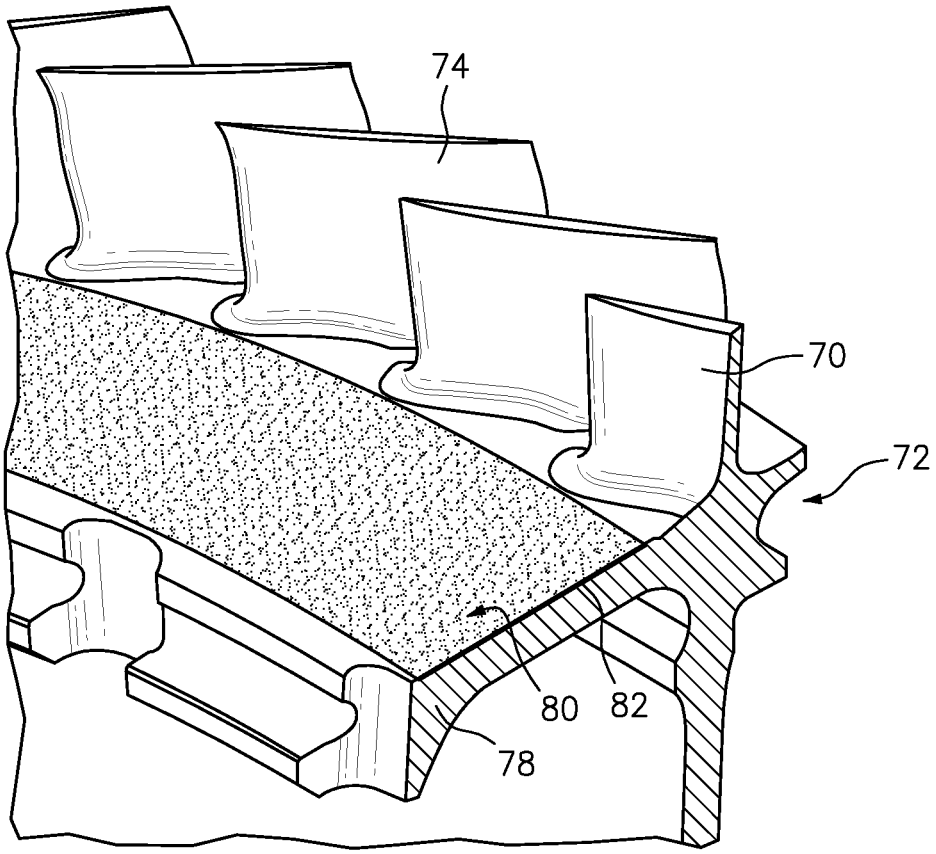
FIG. 3 is a perspective view of a rotor disk with an abrasive section according to one disclosed non-limiting embodiment.

With reference to FIG. 3, the abrasive section 80 is applied to a substrate 79 (FIG. 3) which, in this example, is the hub surface 78. The substrate 79 may be any of a variety of metals, or more typically, metal alloys such as a nickel, titanium, or other high temperature resistant alloy. For example, the substrate 79 can be a high temperature, heat-resistant alloy, e.g., a superalloy. Illustrative high temperature nickel-based alloys are designated by the trade names Inconel®, Nimonic®, Rene®, and Udimet®. The type of substrate component can vary widely, but it is herein representatively in the form of a turbine part or component, such as the rotor disk 72.

Figure 4:
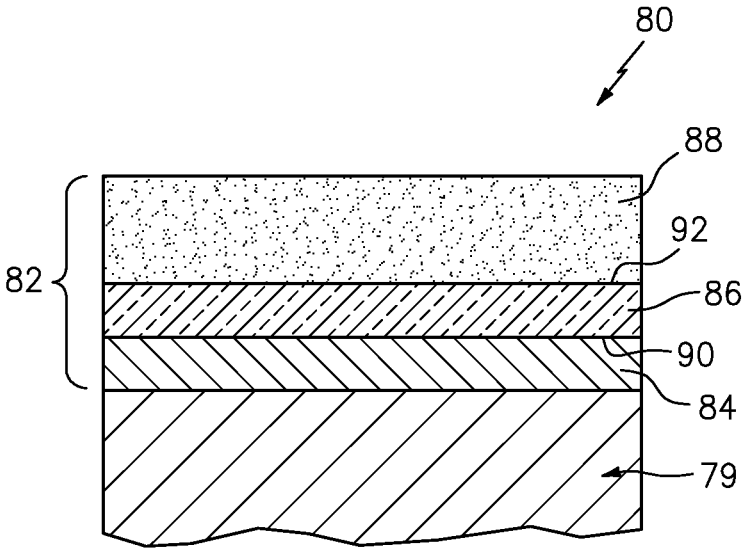
FIG. 4 is a side sectional view of an abrasive coating.

With reference to FIG. 4, the abrasive section 80, according to one disclosed non-limiting embodiment, is fashioned as an abrasive coating 82 applied as a multiple of layers to the substrate 79. The layers, in this embodiment include a metallic based bond coat layer 84 (e.g., nickel based, copper based or cobalt based alloy), an intermediate layer 86, and a top layer 88. The thickness of the abrasive coating 82 in one specific example, as applied to the substrate 79 is typically in the range of from 1 to 100 mils (25 to 2540 microns), and more specifically, 10-40 mils (250 to 1000 microns) but may depend upon a variety of factors, including the component that is involved. In this rotor disk 72 embodiments, the abrasive coating 82 is typically relatively thin and is usually in the range of from 1 to 30 mils (from 25 to 762 microns), and more typically from 3 to 20 mils (from 76 to 508 microns).

The metallic based bond coat layer 84, in a graded example, may be 2.5-10 mils (64-254 microns) thick and have a porosity of 5 volume percent (FIG. 6). The grading need not be continuous and may, for example, be discrete layers with different ratios, or a single layer with a mixture of material such as a 50/50 ratio. In another example in which the abrasive coating 82 is not graded and has no transition layers 90, 92 (FIG. 5), the metallic based bond coat layer 84 may be 3-12 mils (76-305 microns) thick. The metallic based bond coat layer 84 may form 0.1-0.5 fraction of the total thickness of the abrasive coating 82 (FIG. 7).

The bond coat layer 84 is typically formed from a metallic oxidation-resistant material that protects the underlying substrate and enables the intermediate layer 86 to more effectively adhere. Suitable materials for the bond coat layer 84 include MCrAlY alloy powders, where M represents a metal such as iron, nickel, platinum or cobalt, in particular, various metal aluminides such as nickel aluminide and platinum aluminide.

The bond coat layer 84 can be applied, deposited or otherwise formed on the substrate by any of a variety of conventional techniques, such as physical vapor deposition (PVD), including electron beam physical vapor deposition (EBPVD), plasma spray, including air plasma spray (APS) and vacuum plasma spray (VPS), or other thermal spray deposition methods such as high velocity oxy-fuel (HVOF) spray, detonation, or wire spray, chemical vapor deposition (CVD), or combinations of such techniques, such as, for example, a combination of plasma spray and CVD techniques. Usually, the deposited bond coat layer 84 has a thickness in the range of from 1 to 19.5 mils (from 25 to 495 microns). For bond coat layers 84 deposited by PVD techniques such as EBPVD, the thickness is more typically in the range of from 1 to 3 mils (25 to 76 microns). For bond coat layers deposited by plasma spray techniques such as APS, the thickness is more typically in the range of from 3 to 15 mils (from 76 to 381 microns).

The intermediate layer 86 is a zirconia based layer which, in one graded example, is on the order of 1-4 mils thick (25-102 microns) and has a porosity of 4 volume percent (FIG. 6). In another example which is not graded, the intermediate layer 86 may be 1.5-6 mils (38-152 microns) thick. The intermediate layer 86 may form 0.05-0.3 fraction of the total thickness of the abrasive coating 82 (FIG. 7).

In this example, the intermediate layer 86 includes, but is not limited to, partially stabilized zirconia, for example, 7 weight percent yttria stabilized zirconia (YSZ), and cubic zirconia base ceramics, for example, gadolinia stabilized zirconia. All amounts, parts, ratios and percentages used herein are by weight unless otherwise specified. Optimization can include a combination of base material properties, coating architecture, and coating porosity levels. Alternatively, other suitable materials include various zirconias, in particular chemically stabilized zirconias (i.e., various metal oxides such as yttrium oxides blended with zirconia), such as yttria-stabilized zirconias, ceria-stabilized zirconias, calcia-stabilized zirconias, scandia-stabilized zirconias, magnesia-stabilized zirconias, india-stabilized zirconias, ytterbia-stabilized zirconias as well as mixtures of such stabilized zirconias. Other suitable yttria-stabilized zirconias can include from 1 to 20 percent yttria (based on the combined weight of yttria and zirconia), and more typically from 3 to 10 percent yttria. These chemically stabilized zirconias can further include one or more of a second metal (e.g., a lanthanide or actinide) oxide such as dysprosia, erbia, europia, gadolinia, neodymia, praseodymia, urania, and hafnia to further reduce thermal conductivity.

The top layer 88 includes an aluminum oxide layer that, in one graded example, may be 4.5-18 mils (114-457 microns) thick and have a porosity of less than 20 volume percent. In another example which is not graded, the top layer 88 may be 5.5-22 mils (140-559 microns) thick. The top layer 88 may form 0.2-0.6 fraction of the total thickness of the abrasive coating 82 (FIG. 7).

As used herein, the terms "alumina" and "aluminum oxide" refer interchangeably to those compounds and compositions comprising $Al_2O_3$, including unhydrated and hydrated forms.

Figure 5:
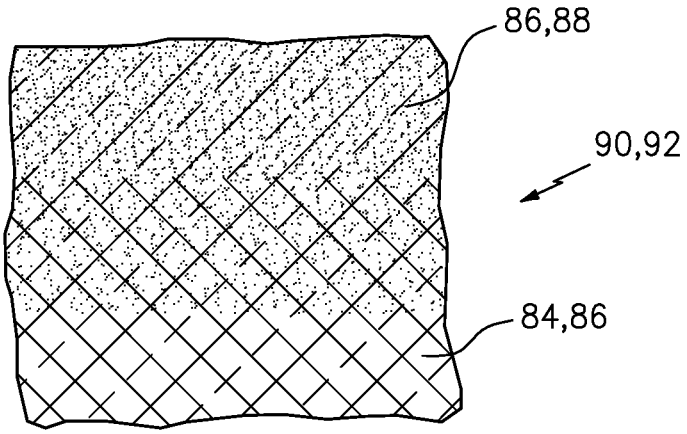
FIG. 5 is a side sectional view of a graded transition.

In one embodiment, a graded transition 90 between the bond coat layer 84 and the intermediate layer 86, and a graded transition 92 between the intermediate layer 86 and the top layer 88 may be provided. The graded transitions 90, 92 may be 1 to 4 mils (25-102 microns) thick between where the adjacent layers are at 100 percent and provide a blended transition between the adjacent layers. The graded transitions 90, 92 may form a 0-0.3 fraction of the total thickness of the abrasive coating 82 (FIG. 7). In the graded embodiment, there is not a hard demarcation (as in the non-graded embodiment) between the bond coat layer 84 and the intermediate layer 86, and between the intermediate layer 86 and the top layer 88 but a blended transition therebetween (FIG. 5).

The graded transitions 90, 92 minimize the local stresses which negatively impact the durability of the abrasive coating 82. Less distinction between layers minimizes formation of a delamination type of crack that is generally parallel to the surface of the substrate. Root causes of the premature spallation are a lack of strain tolerance due to mismatch and high mechanical strains causing spallation at the high stress locations. This may cause a loss in efficiency and operability.

The graded transition 90, 92 minimizes the abrupt change in properties as well as stress concentrations related thereto. The absolute properties of the coating layer itself reduce the crack combination stresses and the properties of that layer improve tolerance to strain and resistance to delamination.

Figure 8:
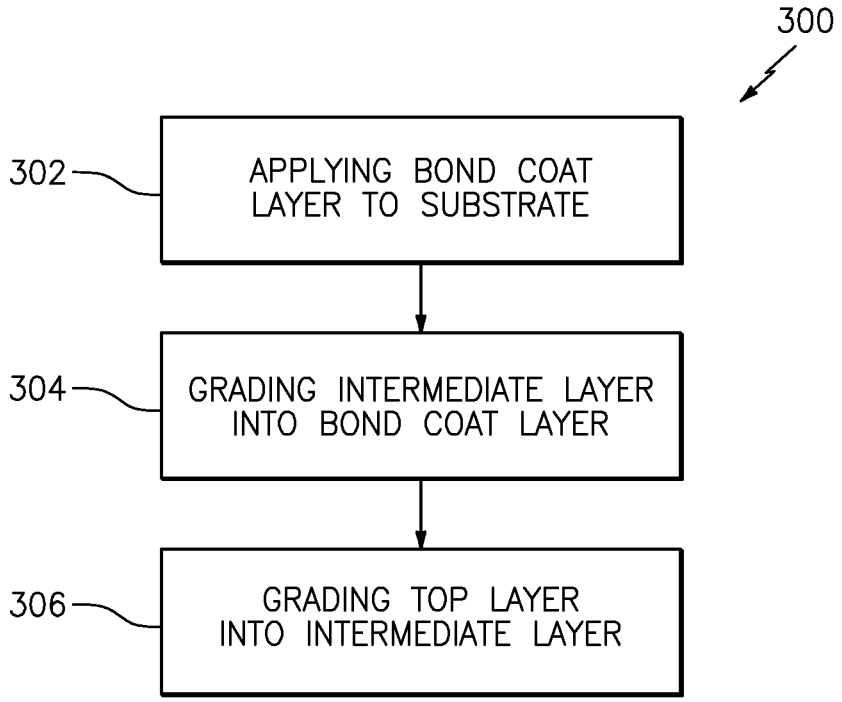
FIG. 8 is a flow diagram of a method of applying a coating according to one disclosed non-limiting embodiment.

With reference to FIG. 8, a method 300 for selectively applying the abrasive coating 82 onto the substrate 79 such as the hub surface 78 to form the abrasive section 80 is schematically disclosed in terms of a functional block diagram flowchart. It should be appreciated that alternative or additional steps may be provided without departing from the teaching herein.

Initially, the metallic based bond coat layer 84 is applied to the substrate 79 (step 302). The metallic based bond coat layer 84, in one embodiment, is then graded into the intermediate layer 86 to form the graded transition 90 therebetween (step 304) to form the graded transition 92.

Once the intermediate layer 86 is applied, the top layer 88 is then graded into the intermediate layer 86 which forms the transition 92 (step 306).

Applications of the layers may include use of a plasma spray torch anode which has a nozzle pointed in the direction of the deposit-surface that is being coated. The plasma spray torch is often controlled automatically, e.g., by a robotic mechanism, which is capable of moving the gun in various patterns across the surface. The plasma plume extends in an axial direction between the exit of the plasma gun anode and the substrate surface. A powder injection system is disposed at a predetermined, desired axial location between the anode and the substrate surface. The powder particles, entrained in a carrier gas, are propelled through the injector and into the plasma plume. The particles are then heated in the plasma and propelled toward the substrate. The particles melt, impact on the substrate, and quickly cool to form the abrasive coating.

Figure 9:
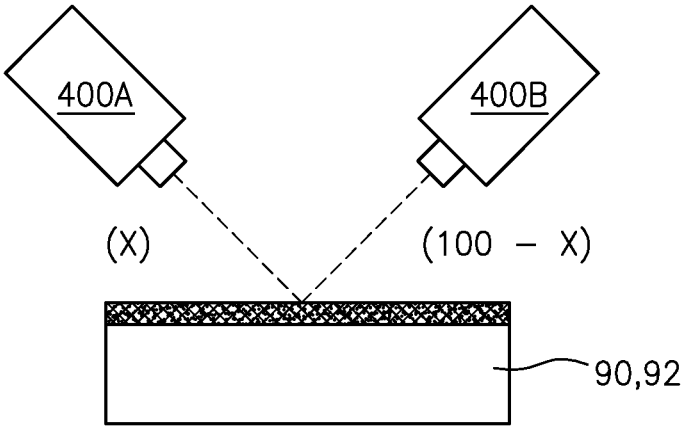
FIG. 9 is a schematic view of a system to provide the graded coating.

In forming the abrasive coating 82, grading can be achieved by blending, mixing or otherwise combining the materials together (e.g., powder particles) to provide a substantially homogeneous mixture at particular ratios of powders that is then deposited. That is, a single torch with multiple powder feeders deliver multiple powders to the single spray system. Alternatively, two separate spray systems 400A, 400B (FIG. 9) can be utilized to deposit a particular ratio of materials to form the graded transitions 90, 92. For example, to transition from the metallic based bond coat layer 84 into the intermediate layer 86 in a graded manner, one system 400A can initially deposit "X" materials for the metallic based bond coat layer 84 and the other system 400B can deposit 100 percent "Y" materials for the intermediate layer 86. Then, as the graded transition progresses, the system reduces the deposition of materials for the metallic based bond coat layer 84 and increases the deposition of the materials for the intermediate layer 86 until a full 100 percent of materials for the intermediate layer 86 is deposited. It should be appreciated that various percentages may be applied over a predefined period of time to achieve a desired gradient or transition therebetween. That is, if desired, the particular ratio and/or amount of the coating materials can be varied as deposited to provide compositions that vary through the thickness of the abrasive coating 82.

The relatively thin intermediate layer 86, particularly when sprayed with fine particles and parameters that promote strong interparticle bonding, resists propagation of cracks that would have caused delamination in the baseline alumina coating. This facilitates survival of the abrasive coating 82 to protect compressor efficiency and operability.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that relative positional terms such as "forward," "aft," "upper," "lower," "above," "below," and the like are with reference to the normal operational attitude of the vehicle and should not be considered otherwise limiting.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be appreciated that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. An abrasive coating for a nickel based alloy rotor disk for a gas turbine engine comprising:

a metallic based bond coat layer that is 3-12 mils thick, and forms a 0.1-0.5 fraction of the total thickness of the abrasive coating;

a top layer that is 5.5-22 mils thick and has a porosity of between 1-20 volume percent, the top layer forms a 0.2-0.6 fraction of the total thickness of the abrasive coating; and a zirconia based intermediate layer between the metallic based bond coat layer and the top layer, the zirconia based intermediate layer is 1.5-6 mils thick and forms a 0.05-0.3 fraction of the total thickness of the abrasive coating.

2. The abrasive coating as recited in claim 1, wherein the metallic based bond coat is one of a nickel based, copper based, and cobalt based alloy.

3. The abrasive coating as recited in claim 1, wherein the intermediate layer is a partially stabilized zirconia.

4. The abrasive coating as recited in claim 1, wherein the intermediate layer comprises 7 weight percent yttria stabilized zirconia.

5. The abrasive coating as recited in claim 1, wherein the intermediate layer has a porosity of 4 volume percent, and the metallic based bond coat layer has a porosity of 5 volume percent.

6. An abrasive coating for application to a nickel based alloy rotor disk for a gas turbine engine comprising:

a metallic based bond coat layer that forms a 0.1-0.5 fraction of the total thickness of the abrasive coating;

a zirconia based intermediate layer graded into the metallic based bond coat layer to form a graded transition between the metallic based bond coat layer and the intermediate layer, the zirconia based intermediate layer forms a 0.05-0.3 fraction of the total thickness of the abrasive coating, the graded transition between the metallic based bond coat layer and the intermediate layer forms a 0.1-0.3 fraction of the total thickness of the abrasive coating; and a top layer graded into the intermediate layer to form a graded transition between the intermediate layer and the top layer, the top layer forms a 0.2-0.6 fraction of the total thickness of the abrasive coating, the graded transition between the intermediate layer and the top layer forms a 0.1-0.3 fraction of the total thickness of the abrasive coating, and wherein the top layer has a porosity of between 1-20 volume percent.

7. The abrasive coating as recited in claim 6, wherein the graded transition between the metallic based bond coat layer and the intermediate layer and the graded transition between the intermediate layer and the top layer are each 1-4 mils thick.

8. The abrasive coating as recited in claim 6, wherein the metallic based bond coat layer is 2.5-10 mils thick and has a porosity of less than 20 volume percent.

9. The abrasive coating as recited in claim 8, wherein the top layer is 4.5-18 mils thick.

10. The abrasive coating as recited in claim 9, wherein the intermediate layer is 1-4 mils thick.

11. A method of applying the abrasive coating of claim 6, comprising:

applying the metallic based bond coat layer onto a substrate;

grading the intermediate layer into the metallic based bond coat layer to form the graded transition between the metallic based bond coat layer and the intermediate layer; and grading the top layer into the intermediate layer to form the graded transition between the intermediate layer and the top layer.

12. The method as recited in claim 11, wherein grading the intermediate layer into the metallic based bond coat layer comprises spraying materials to form the intermediate layer from a first spray system while spraying materials to form the metallic based bond coat layer from a second spray system.

13. The method as recited in claim 12, wherein the second system reduces deposition of materials for the metallic based bond coat layer while the first system increases deposition of materials for the intermediate layer until a full 100 percent of materials for the intermediate layer is being sprayed by the first system and 0 percent of materials for the metallic based bond coat layer are being sprayed to form the graded transition between the metallic based bond coat layer and the intermediate layer, then the intermediate layer.

14. The method as recited in claim 12, wherein grading the top layer into the intermediate layer comprises spraying top layer materials from a third spray system while spraying the intermediate layer materials from the first spray system.

15. The method as recited in claim 12, wherein grading the top layer into the intermediate layer comprises spraying top layer materials while spraying the intermediate layer materials.

16. A rotor disk for a gas turbine engine, comprising:

a nickel based alloy hub surface adjacent a multiple of rotor blades, the hub surface having an abrasive section comprising an abrasive coating, the abrasive coating comprising:

a metallic based bond coat layer that is 2.5-10 mils thick, has a porosity of 5 volume percent and forms a 0.1-0.5 fraction of the total thickness of the abrasive coating;

a zirconia based intermediate layer graded into the metallic based bond coat layer to form a graded transition between the metallic based bond coat layer and the intermediate layer, wherein the intermediate layer is 1-4 mils thick, has a porosity of 4 volume percent, and forms a 0.05-0.3 fraction of the total thickness of the abrasive coating; and a top layer graded into the intermediate layer to form a graded transition between the intermediate layer and the top layer, the top layer is 4.5-18 mils thick and has a porosity less than 20 volume percent, the top layer forms a 0.2-0.6 fraction of the total thickness of the abrasive coating.

17. The rotor disk as recited in claim 16, wherein a thickness of the abrasive coating is from 10 to 100 mils.

18. The rotor disk as recited in claim 16, wherein a thickness of the abrasive coating is from 10-40 mils.

19. The rotor disk as recited in claim 16, wherein a thickness of the abrasive coating is from 1 to 30 mils.

20. The rotor disk as recited in claim 16, wherein a thickness of the abrasive coating is from 3 to 20 mils.

* * * * *